US012410812B1

(12) United States Patent
Strauss et al.

(10) Patent No.: US 12,410,812 B1
(45) Date of Patent: Sep. 9, 2025

(54) AEROELASTIC FAN BLADE

(71) Applicant: Evapco, Inc., Taneytown, MD (US)

(72) Inventors: Daniel Strauss, Itu (BR); Victor Leonardo Moura Vieira da Silva, Itu (BR); Luigi Martini, Itu (BR)

(73) Assignee: Evapco, Inc., Taneytown, MD (US)

( * ) Notice: Subject to any disclaimer, the term of this patent is extended or adjusted under 35 U.S.C. 154(b) by 0 days.

(21) Appl. No.: 19/073,741

(22) Filed: Mar. 7, 2025

Related U.S. Application Data

(60) Provisional application No. 63/562,548, filed on Mar. 7, 2024.

(51) Int. Cl.
*F04D 29/38* (2006.01)
*F04D 19/00* (2006.01)

(52) U.S. Cl.
CPC ..... *F04D 29/384* (2013.01); *F04D 19/002* (2013.01)

(58) Field of Classification Search
CPC ..... F04D 29/384; F04D 19/002
See application file for complete search history.

(56) References Cited

U.S. PATENT DOCUMENTS

| | | | | |
|---|---|---|---|---|
| 4,028,003 | A | 6/1977 | Krauss | |
| 4,334,824 | A | 6/1982 | Tsuchikawa et al. | |
| 6,378,322 | B1 * | 4/2002 | Calvert | F04D 29/36 416/207 |
| 7,252,479 | B2 | 8/2007 | Bagai et al. | |
| 9,945,389 | B2 * | 4/2018 | Cahill | F04D 29/023 |
| 10,358,929 | B2 * | 7/2019 | McCaffrey | F04D 29/388 |
| 11,873,834 | B2 * | 1/2024 | Yang | F04D 29/325 |
| 2010/0104435 | A1 | 4/2010 | Arlitt et al. | |
| 2021/0363961 | A1 | 11/2021 | Hall et al. | |

OTHER PUBLICATIONS

International Search Report and Written Opinion issued in Application No. PCT/US2025/018960 on May 7, 2025, 8 pages.

* cited by examiner

*Primary Examiner* — Sabbir Hasan
(74) *Attorney, Agent, or Firm* — Whiteford, Taylor & Preston, LLP; Peter J. Davis

(57) ABSTRACT

A fan blade that responds to external perturbations in a way that reduces the effect of the perturbations on the blade. The fan blade is designed so that the twist center is forward of the pressure center relative to the air flow direction, and the distance between the twist center and the pressure center is greater than zero. Fan blades having this feature will deform in a way to decrease aerodynamic load when conditions cause an increase in aerodynamic load and conversely increase aerodynamic load when conditions cause a decrease in aerodynamic load.

2 Claims, 3 Drawing Sheets

AEROELASTIC FAN BLADE

BACKGROUND OF THE INVENTION

Field of the Invention

The present invention relates to fan blade design.

Description of the Background

Axial fans are used on many different applications where it is necessary to move air, such as ventilation, cooling, heating, or pollution control. The fan rotating part (the rotor) is composed of a part that produces the aerodynamic forces (the blade) and a part that fixes the fan to the drive shaft (the hub). The rotor can be composed of a single piece where the blades and hub are one integral part, or the blades and hub can be separate parts that are assembled together to compose the fan. In both options, the blade is subject to the aerodynamic and inertia forces that are transmitted to the fan drive shaft through the hub. All the parts (blades and hub) must withstand these loads in order to avoid mechanical failure of the fan.

During operation, most fans are subject to external perturbations that affect their operation and cause the loads to change in time. These perturbations can be due to external environmental conditions such as wind, geometry of the equipment where the fan is installed such as in an asymmetric inflow condition, influence of other nearby fans in operation, and many other conditions. Examples of applications subject to wind influence include forced draft air cooled condensers. Examples of applications with asymmetric inflow conditions include back-to-back cooling towers and fans installed close to walls. Examples of applications where influence of other fans is a factor include where multiple fans are operating in parallel in a single inlet.

There are multiple results of load variation caused by these external perturbations, and they cause a detrimental effect on fan operation and fan durability. On the performance side, the aerodynamic loads are the forces that cause the air movement, so if the aerodynamic loads change over time, the performance of the fan in terms of airflow, static pressure and efficiency, also changes in time. This can compromise the functioning of the equipment where the fan is installed or the expected ventilation by the fan. In another aspect, the load variation on the fan can also induce mechanical problems such as vibration or fatigue in the fan itself or in the equipment where the fan is assembled.

The current solution for this problem in the art is to design fans that have a very robust structure to withstand the variable loads which solution makes the fan more expensive. While a robust structure prevents problems in the fan itself, it requires that the structure where the fan is attached also be very robust, which increases costs further. Another solution is to use a flexible joint between the blade and hub which prevents the transmission of the loads from the fan to the support structure but requires the use of expensive components to achieve the required flexibility. This solution also does not mitigate the effects on performance. The results from these limitations of the prior art are 1) the use of more or larger fans is required to compensate for the performance limitations and/or 2) to impose operational limits on the fans, such as rotating speed or number of blades.

BRIEF DESCRIPTION OF THE DRAWINGS

The following detailed description of the invention will be better understood when read in conjunction with the appended drawings. For the purpose of illustrating the invention, there are shown in the drawings various embodiments which are presently preferred. It should be understood, however, that the invention is not limited to the precise arrangements and instrumentalities shown. In the drawings.

DETAILED DESCRIPTION OF THE INVENTION

The present invention is directed to an aeroelastic fan blade design that mitigates the effect of the external perturbations. Using computational fluid dynamics (CFD) and finite element analysis (FEA) simulations, the inventors studied fan blade aerodynamic behavior of various blade designs under various pressure distributions and aerodynamic loads on the surface of the blades to determine deformations of the various blade designs under the various pressure distributions and aerodynamic loads. In particular, the inventors searched for a combination of aerodynamic and structural design features that would cause a fan blade to behave in a way that 1) perturbations that cause an increase in load will cause the blade to deform in a way that reduces the load, and 2) perturbations that cause a decrease in load will cause the blade to deform in a way that increases the load. Therefore, the problem was to find a design feature or combination of features the result of which the behavior of the blade in operation when subject to external perturbations is to reduce the effect of these perturbations. In this way the effects of the external perturbations would be mitigated and the detrimental effects on performance, vibration and fatigue would be prevented.

Figure 1:
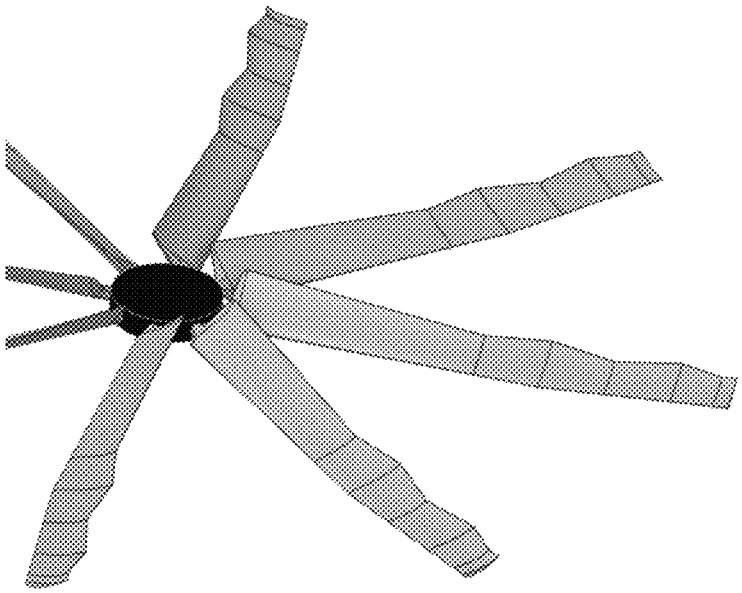
FIG. 1 is an example of a large format fan that can benefit from the present invention.
Figure 2:
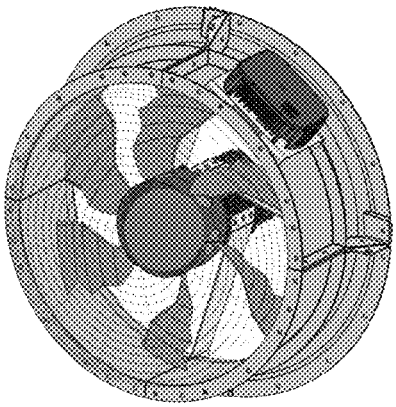
FIG. 2 is an example of a small fan that can benefit from the present invention.
Figure 3:
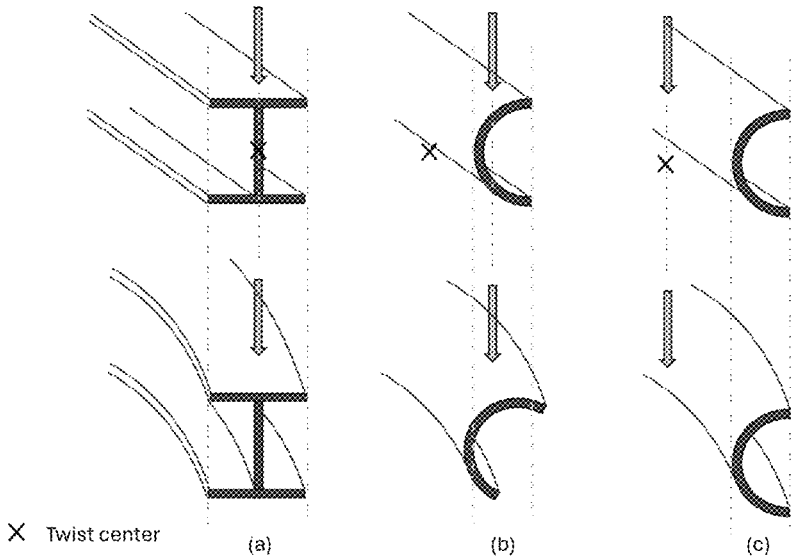
FIG. 3 is a representation of beam deformation under different twist conditions.

The inventors discovered that the desired response to perturbations on the fan blade is achieved when the pressure center of the blade is behind the twist center of the blade (relative to the air flow direction), and the distance $\Delta S$ between the pressure center and the twist center is greater than zero. The twist center is defined as the point over which the blade twists when subjected to a torque. As shown in FIG. 3, for cases (a) and (b), when a load is applied on the center of mass of a beam, the beam will bend. In the case of a symmetric section (a), the twist center coincides with the mass center so the beam bends but does not twist. In the case of an asymmetrical section beam (b) the twist center does not coincide with the center of mass with the result that the deflection of the beam results in bending and twisting. Considering the same beam as in case (b) but applying the load on the twist center, the resulting movement is bending only as shown in (c).

A fan blade functions as a lifting surface when in operation, and the blade profile generates a pressure distribution on the blade surface resulting in aerodynamic loads. The pressure center is defined as the point of the blade where the aerodynamic force is applied, which is equivalent to the point of the blade where the aerodynamic moment is zero. According to the present invention, the pressure center and twist center of the blade are positioned such that a perturbation that causes an increase in the aerodynamic load will result in a twist deformation of the blade that results in a reduction of the aerodynamic load.

Figure 4:
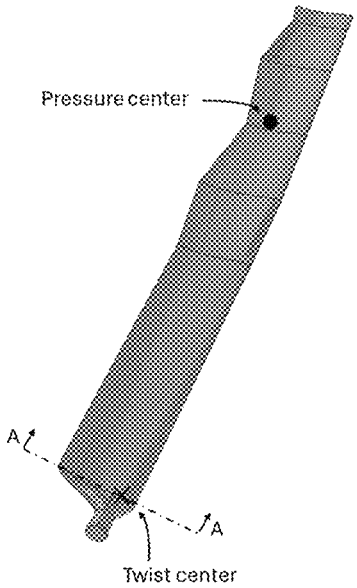
FIG. 4 is an example of a large fan blade according to the invention.
Figure 5:
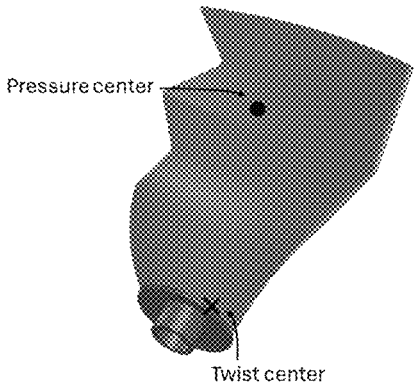
FIG. 5 is an example of a small fan blade according to the invention.
Figure 6:
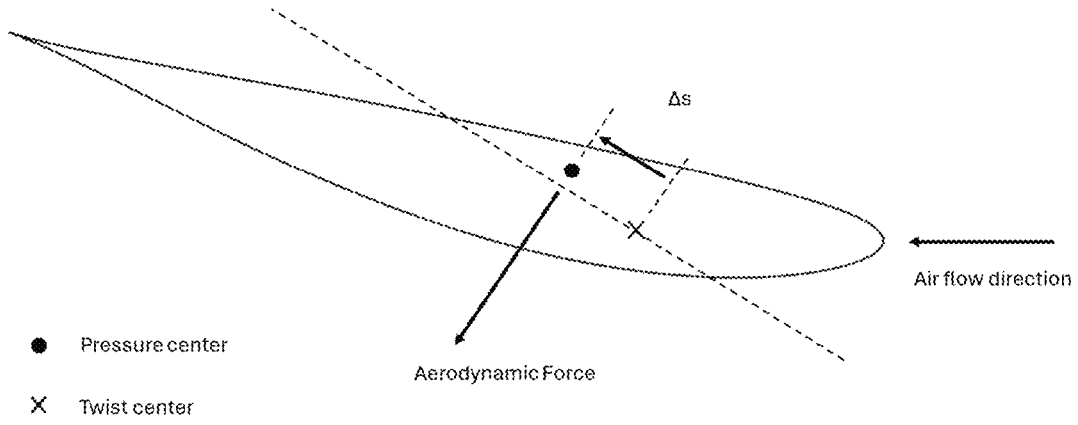
FIG. 6 is a representation of a fan blade cross-section showing the relative locations of twist center, pressure center, air flow direction and aerodynamic force variables relating to the present invention.

FIGS. 4 and 5 show examples of examples of the invention embodied in a large diameter fan blade and in a small diameter fan blade, respectively. FIG. 6 is a representation of the cross-section of both the blades of FIGS. 4 and 5. Referring now specifically to FIG. 6, the relative positions of the pressure center, the twist center, the air flow direction, and the aerodynamic force are shown. Considering the axis defined by the line passing through the twist center, perpendicular to the aerodynamic force direction and oriented from the leading edge to the trailing edge of the blade, the aeroelastic behavior of the present invention is obtained when the distance $\Delta s$ is greater than zero. If $\Delta s$ is lower than zero, then the aeroelastic behavior is not obtained. This relationship having been discovered, the person of ordinary skill can readily and repeatedly design and build fan blades that meet the requirements of the invention, combining blade geometry such as profile, chord size, torsion and blade structure such as material characteristics, thickness, position of reinforcements. Fan blades made according to the invention do not require excessively robust structure or complicated flexible components and therefore constitute a more cost effective solution than the prior art. Also, since the aerodynamic load variation is minimized, the performance of the fan is improved during the operation even with external perturbations.

Notwithstanding the specific embodiments, features, elements, combinations and sub-combinations disclosed herein, it is expressly considered and here disclosed that every single element, every single feature, and every combination and sub-combination thereof disclosed herein may be combined with every other element, feature, combination and sub-combination disclosed herein.

It will be appreciated by those skilled in the art that changes could be made to the embodiments described above without departing from the inventive concept thereof. It is understood, therefore, that this invention is not limited to the particular embodiments disclosed, but it is intended to cover modifications within the spirit and scope of the present invention as outlined in the present disclosure and defined according to the broadest reasonable reading of the claims that follow, read in light of the present specification.

The invention claimed is:

1. A fan blade having a leading edge, a twist center and a pressure center, wherein the twist center is disposed forward of the pressure center relative to the leading edge and where the distance between the twist center and the pressure center is greater than zero, such that conditions that cause an increase in aerodynamic load on the fan blade produces a twist deformation of the fan blade that results in a reduction of the aerodynamic load and such that conditions that cause a decrease in aerodynamic load on the fan blade produce a twist deformation of the fan blade the results in an increase of the aerodynamic load.

2. A method of designing and manufacturing a fan blade having a leading edge, a twist center and a pressure center, the method comprising designing the fan blade so that the twist center is disposed forward of the pressure center relative to the leading edge and where the distance between the twist center and the pressure center is greater than zero, wherein conditions that cause an increase in aerodynamic load on the fan blade produces a twist deformation of the fan blade that results in a reduction of the aerodynamic load and wherein conditions that cause a decrease in aerodynamic load on the fan blade produce a twist deformation of the fan blade the results in an increase of the aerodynamic load.

* * * * *